US009861192B2

(12) United States Patent
Wu

(10) Patent No.: US 9,861,192 B2
(45) Date of Patent: Jan. 9, 2018

(54) LIFTABLE TABLE

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 0 days.

(21) Appl. No.: 15/232,797

(22) Filed: Aug. 9, 2016

(65) Prior Publication Data

US 2017/0273453 A1 Sep. 28, 2017

(30) Foreign Application Priority Data

Mar. 22, 2016 (CN) ..... 2016 2 0220965 U

(51) Int. Cl.

| | |
|---|---|
| ***A47B 9/00*** | (2006.01) |
| ***A47B 21/02*** | (2006.01) |
| ***A47B 9/16*** | (2006.01) |
| ***A47B 13/08*** | (2006.01) |
| ***A47B 83/04*** | (2006.01) |

(52) U.S. Cl.

CPC ..... *A47B 21/02* (2013.01); *A47B 9/00* (2013.01); *A47B 9/16* (2013.01); *A47B 13/081* (2013.01); *A47B 13/088* (2013.01); *A47B 83/045* (2013.01)

(58) Field of Classification Search

CPC .. A47B 1/056; A47B 1/04; A47B 1/02; A47B 3/12; A47B 3/06; A47B 87/002; A47B 12/008; A47B 2200/0056; F16M 11/24; F16M 11/2014; F16M 11/2092; F16M 11/38; F16M 2200/004; F16M 2200/063; B66F 7/0608; B66F 7/065

USPC ..... 108/145, 144.11, 147, 93, 96, 116–118, 108/138, 50.01, 50.02, 14, 13, 11, 4, 9, 108/10, 33, 39; 312/208.1, 223.3, 306, 312/312; 248/421, 562, 588, 585, 431, 248/432, 439, 280.11, 292.11, 919, 920, 248/923

See application file for complete search history.

(56) References Cited

U.S. PATENT DOCUMENTS 5,588,377 A * 12/1996 Fahmian ..... A47B 9/00 108/145
5,996,961 A * 12/1999 Johnson ..... A47B 9/16 248/157
D588,832 S * 3/2009 Mohundro ..... D6/667

(Continued)

FOREIGN PATENT DOCUMENTS

| | | | |
|---|---|---|---|
| CN | 104647338 | * | 5/2015 |
| FR | 3028735 | * | 5/2016 |
| JP | 10330093 | * | 12/1998 |

*Primary Examiner* — Janet M Wilkens
(74) *Attorney, Agent, or Firm* — Pai Patent & Trademark Law Firm; Chao-Chang David Pai

(57) ABSTRACT

A liftable table has a table frame, a fixing board, a lifting device, and a table board. The table frame has a main frame and a holding seat. The holding seat is deposited on the main frame. The fixing board is mounted on the main frame. The lifting device is deposited on the holding seat and has a driving set and at least one crossing set. The crossing set is extended from or folded in the receiving space of the holding seat, and is connected to and driven by the driving set. The table board is deposited on the crossing set to move upwardly or downwardly. A user views and operates a computer put on the table board with a sitting or a standing posture, and this prevents the user from using the computer with the sitting posture for a long time and avoids damages to the user's health.

12 Claims, 9 Drawing Sheets

(56) References Cited

U.S. PATENT DOCUMENTS

| | | | | |
|---|---|---|---|---|
| 7,677,518 | B2 * | 3/2010 | Chouinard | A47B 21/02 108/10 |
| 9,635,929 | B1 * | 5/2017 | Wu | A47B 9/00 |
| 2003/0047488 | A1 * | 3/2003 | Takehira | B01J 23/755 208/137 |
| 2004/0040480 | A1 * | 3/2004 | Hwang | A47B 3/02 108/145 |
| 2004/0094077 | A1 * | 5/2004 | Stone | B66F 17/00 108/147 |
| 2006/0087166 | A1 * | 4/2006 | Trippensee | A61G 5/043 297/338 |
| 2007/0034125 | A1 * | 2/2007 | Lo | B66F 7/0608 108/145 |
| 2014/0158024 | A1 * | 6/2014 | Henriott | A47B 13/00 108/27 |

* cited by examiner

LIFTABLE TABLE

BACKGROUND OF THE INVENTION

1. Field of the Invention

The present invention relates to a liftable table, and more particularly to a table that can be adjusted upwardly or downwardly.

2. Description of Related Art

As technology advances, users may work heavily relying on the assistance of computers, so it takes a long time for users to face the computer monitors. Since a height of a conventional table cannot be adjusted, the user needs to adjust a height of the chair to adjust a relative height between the user's eyes and the computer screen to enable the user to view the computer monitor at a more comfortable position and to reduce the pressure on the user's neck.

However, when the user remains seated on the chair and uses the computer for a long time, this will cause some damages to the user's health. Therefore, it has been advocated for users to stand up and change postures from time to time. When the user is standing, since the height of the conventional table cannot be adjusted, the height of the computer monitor cannot be adjusted. Then, the relative distance between the user's eyes and the computer monitor cannot be adjusted at the same time, and the user cannot use the computer when standing, and only after standing for a moment, the user sits down again and continues to work, and this is convenient in use.

SUMMARY OF THE INVENTION

The main objective of the invention is to provide a liftable table that can be adjusted upwardly or downwardly.

The liftable table in accordance with the present invention has a table frame, a fixing board, a lifting device, and a table board. The table frame has a main frame and a holding seat. The holding seat is deposited on the main frame. The fixing board is mounted on the main frame. The lifting device is deposited on the holding seat and has a driving set and at least one crossing set. The crossing set is extended from or folded in the receiving space of the holding seat, and is connected to and driven by the driving set. The table board is deposited on the crossing set to move upwardly or downwardly. A user views and operates a computer that is put on the table board with either sitting or standing postures, and this prevents the user from using the computer with the sitting posture for a long time and avoids causing some damages to the user's health.

Other objectives, advantages and novel features of the invention will become more apparent from the following detailed description when taken in conjunction with the accompanying drawings.

DETAILED DESCRIPTION OF PREFERRED EMBODIMENT

Figure 1:
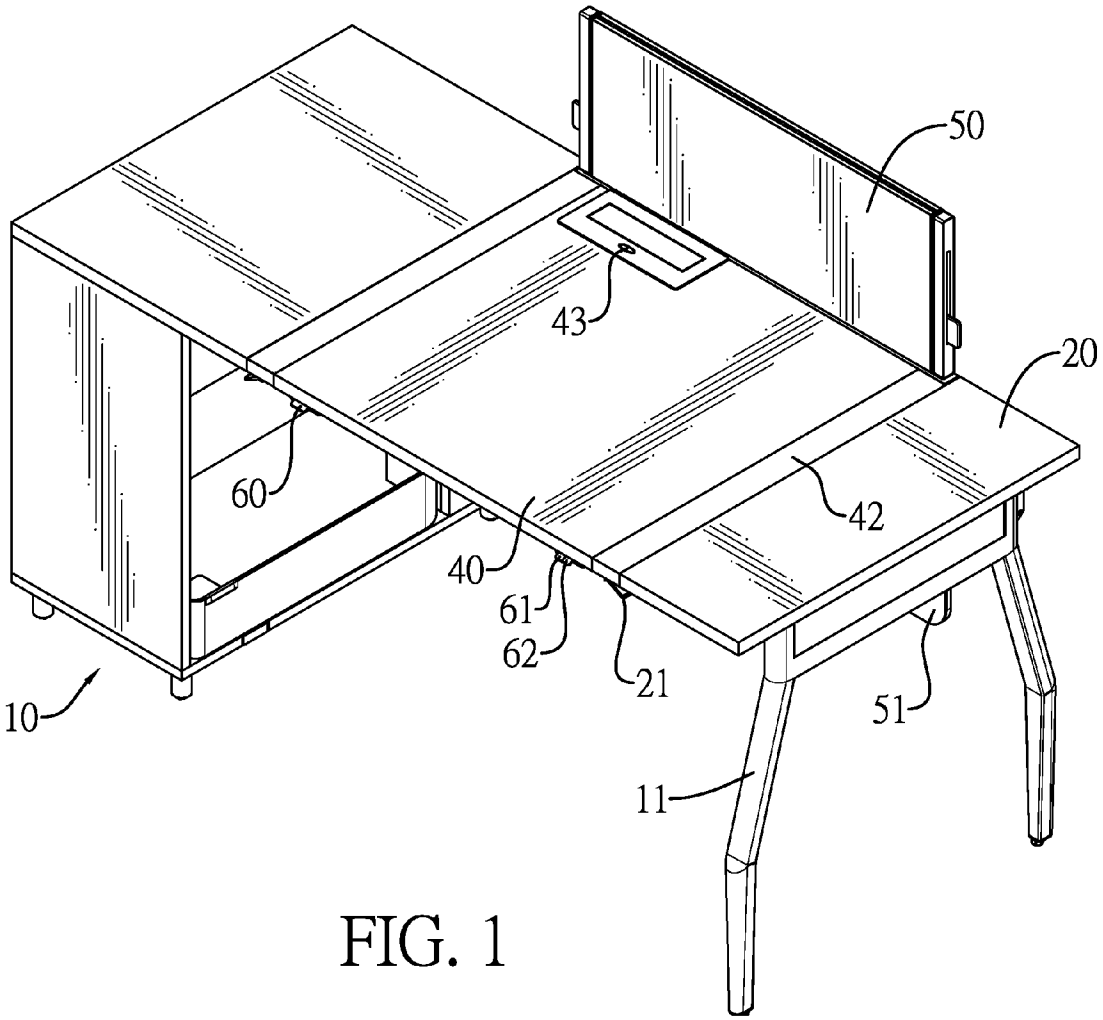
FIG. 1 is a perspective view of a liftable table in accordance with the present invention.
Figure 2:
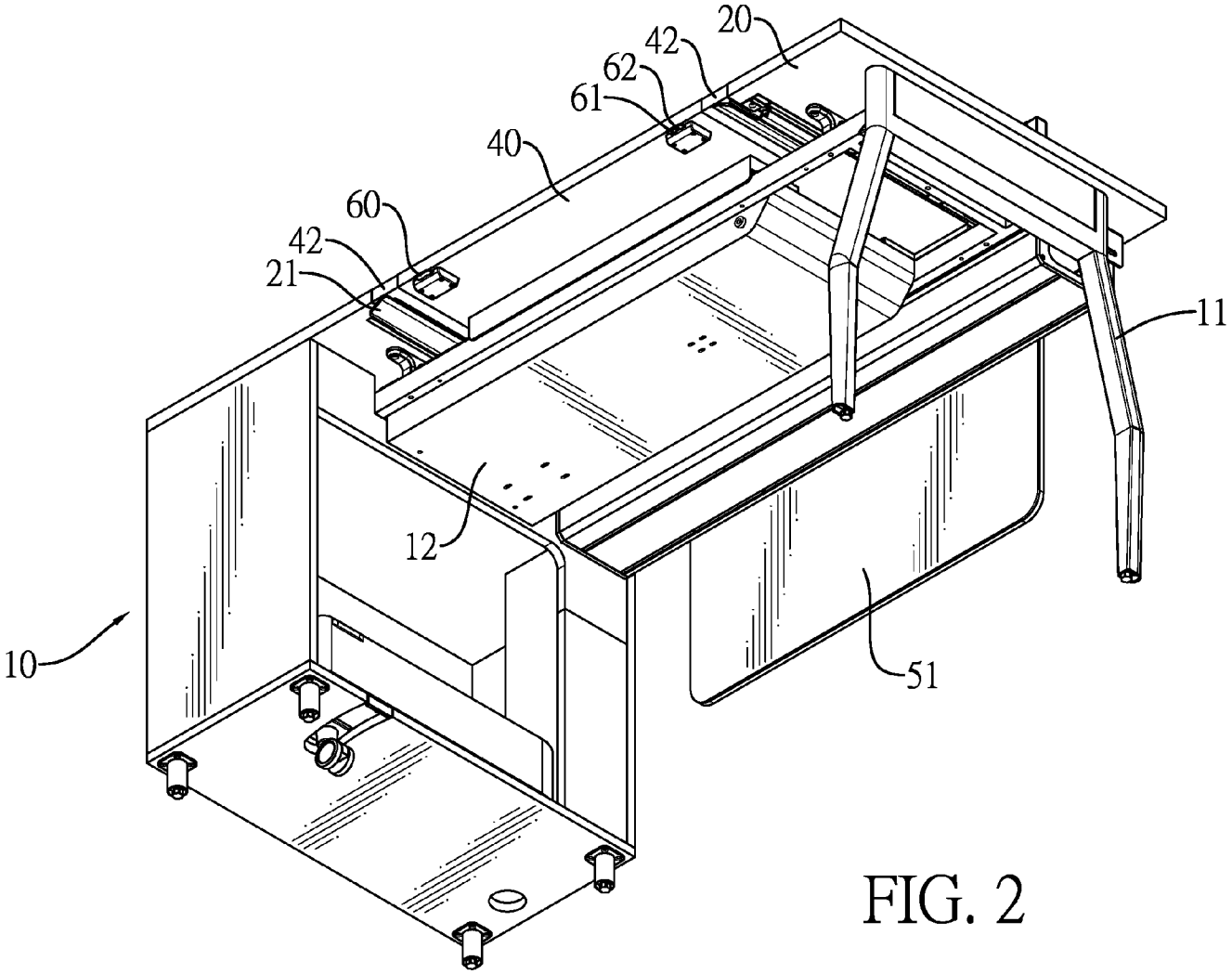
FIG. 2 is another perspective view of the liftable table in FIG. 1.
Figure 3:
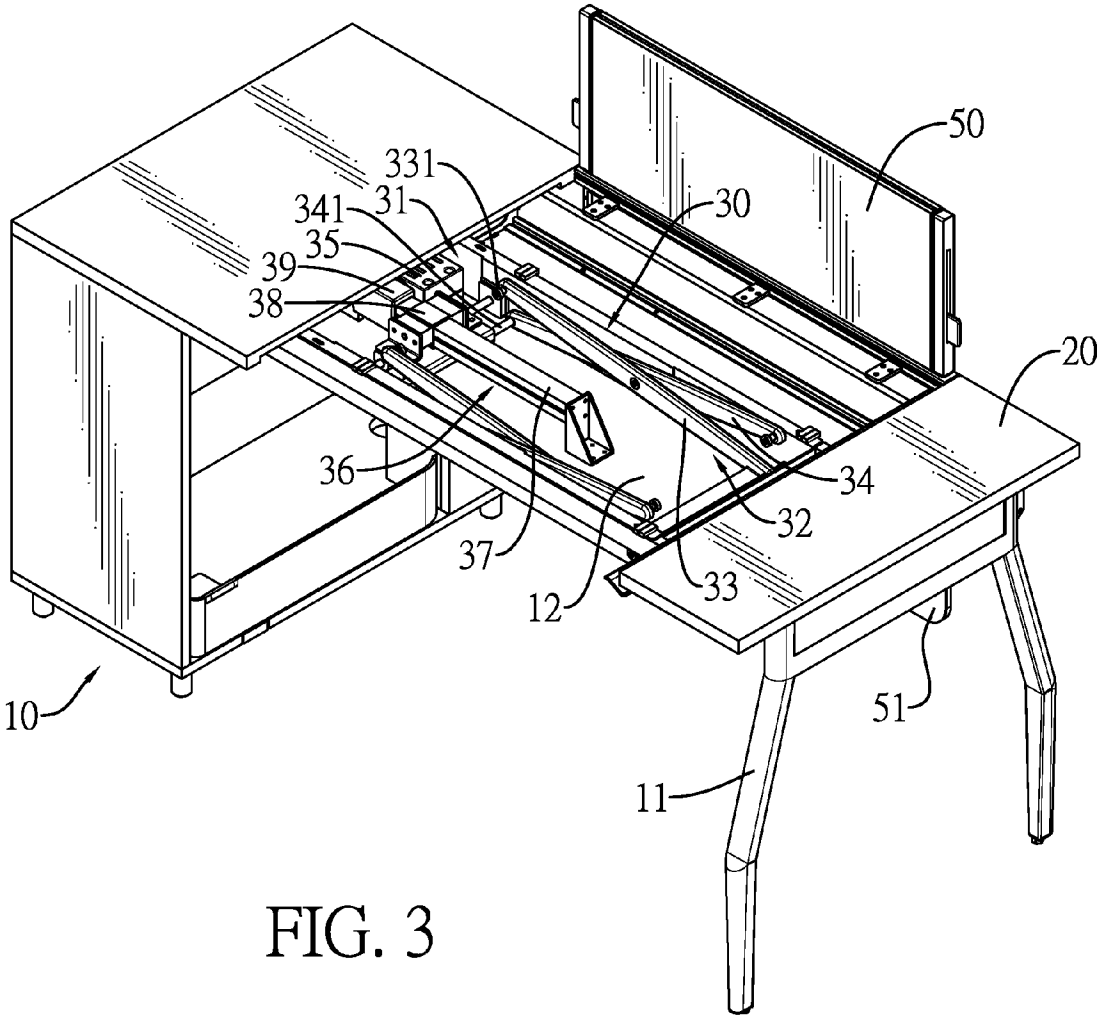
FIG. 3 is an operational perspective view of the liftable table in FIG. 1, showing a table board of the liftable table removed.

With reference to FIGS. 1 to 3, a liftable table in accordance with the present invention comprises a table frame 10, a fixing board 20, a lifting device 30, and a table board 40.

With reference to FIGS. 1 to 3 and 5, the table frame 10 has a main frame 11 and a holding seat 12. The holding seat 12 is deposited on the main frame 11, and has a top side, an inner side, an opening, a receiving space, and at least one first sliding recess 13. The opening is formed through the top side of the holding seat 12. The receiving space is formed in the holding seat 12 and communicates with the opening. The at least one first sliding recess 13 is formed in the inner side of the holding seat 12.

With reference to FIGS. 2 and 3, the fixing board 20 is mounted on the main frame 11 of the table frame 10, and has two inner edges, an embedding space, and two blocking sheets 21. The embedding space is deposited between the inner edges of the fixing board 20 for receiving the table board 40 and communicates with the receiving space of the holding seat 12. With reference to FIGS. 6 to 9, each one of the blocking sheets 21 is restorably pivoted on one of the inner edges of the fixing board 20 adjacent to the embedding space of the fixing board 20. Furthermore, each one of the blocking sheets 21 has a rotating rod 23 and multiple torsion springs 22. The rotating rod 23 is mounted through the blocking sheet 21 and is pivotally connected to the fixing board 20 at the inner edge of the fixing board 20. The torsion springs 22 are mounted around the rotating rod 23 at spaced intervals and abut against the blocking sheet 21.

The lifting device 30 is deposited on the holding seat 12 of the table frame 10 and has a driving set 31 and at least one crossing set 32. The driving set 31 is deposited on the holding seat 12. The at least one crossing set 32 is extended from or folded in the receiving space of the holding seat 12, and is connected to and driven by the driving set 31. Each one of the at least one crossing set 32 has a first pivot arm 33 and a second pivot arm 34. The first pivot arm 33 has a lower end connected to the holding seat 12 by hinges. The second pivot arm 34 is pivotally connected to the first pivot arm 33, has a lower end connected to the driving set 31, and is moveable along the at least one first sliding recess 13.

The table board 40 is deposited on an upper end of the at least one crossing set 32 of the lifting device 30 to move upwardly or downwardly relative to the table frame 10, and has a bottom, two opposite sides, at least one second sliding recess 41, and two buffering blocks 42. The bottom of the table board 40 faces the opening of the holding seat 12. The opposite sides of the table board 40 respectively face the inner edges of the fixing board 20.

The at least one second sliding recess 41 is formed in the bottom of the table board 40, and an upper end of the first pivot arm 33 of the at least one crossing set 32 is slidably mounted in the at least one second sliding recess 41. In addition, an upper end of the second pivot arm 34 of the at least one crossing set 32 is connected to the table board 40 by hinges. The buffering blocks 42 may be made of polyurethane, rubber or other materials that may provide a buffering effect, and are respectively deposited on the opposite sides of the table board 40 and respectively corresponding to the blocking sheets 21 of the fixing board 20.

Furthermore, the lifting device 30 has two crossing sets 32, and the two crossing sets 32 are deposited in the holding seat 12 symmetrically and side by side. In addition, the holding seat 12 has two first sliding recesses 13 formed in the inner side of the holding seat 12. Further, the table board 40 has two second sliding recesses 41 formed in the bottom of the table board 40.

Figure 5:
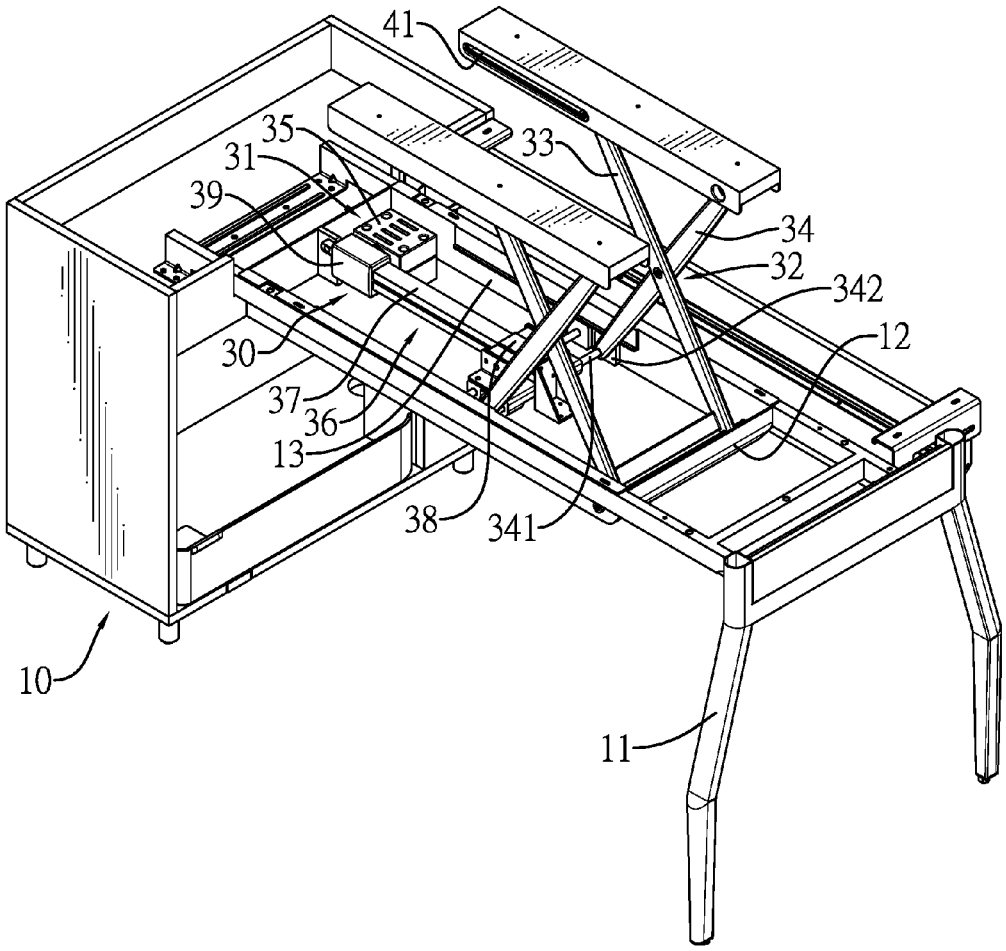
FIG. 5 is an operational perspective view of the liftable table in FIG. 1, showing a lifting device of the liftable table extended.
Figure 6:
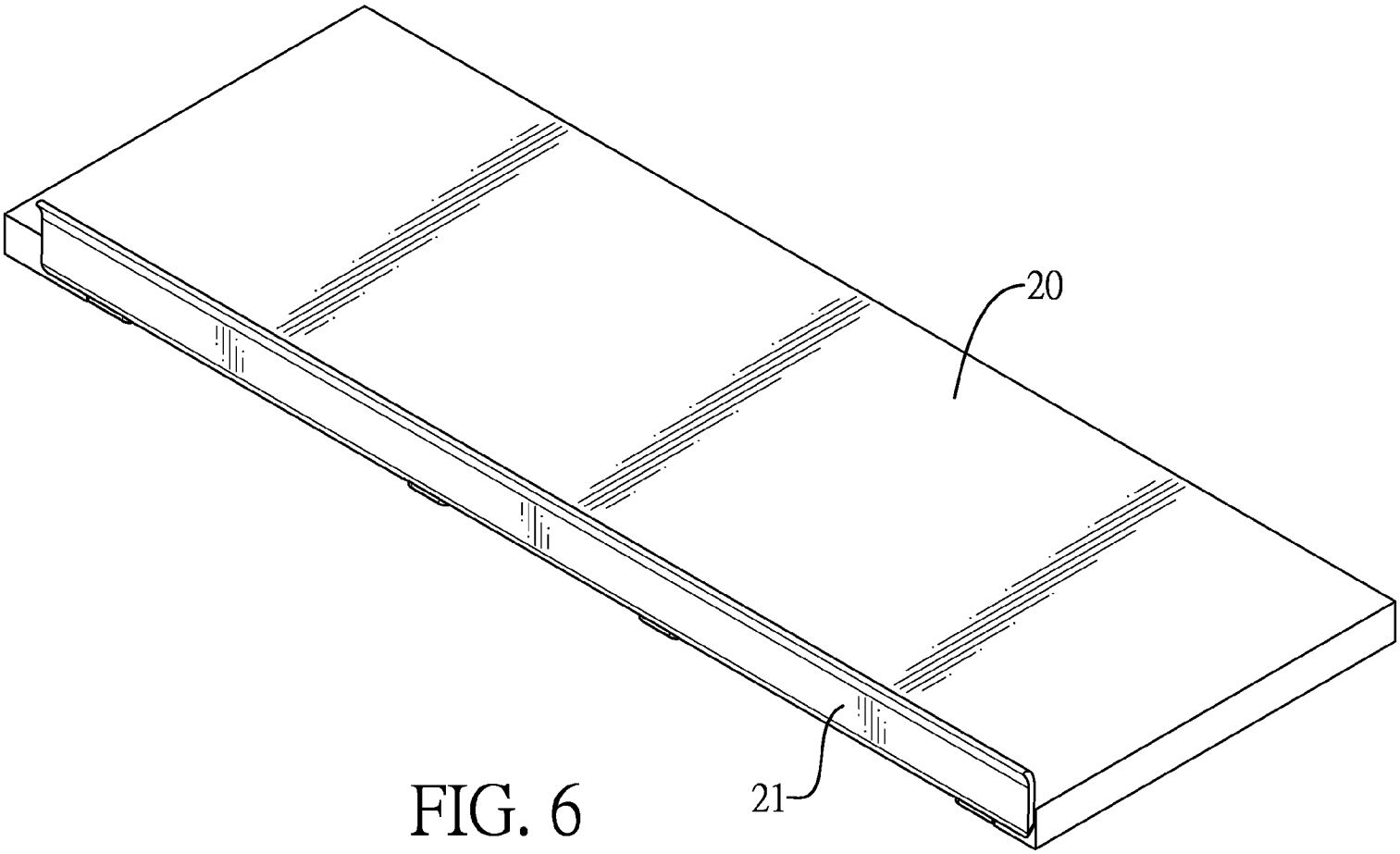
FIG. 6 is an enlarged perspective view of a fixing board of the liftable table in FIG. 1.
Figure 7:
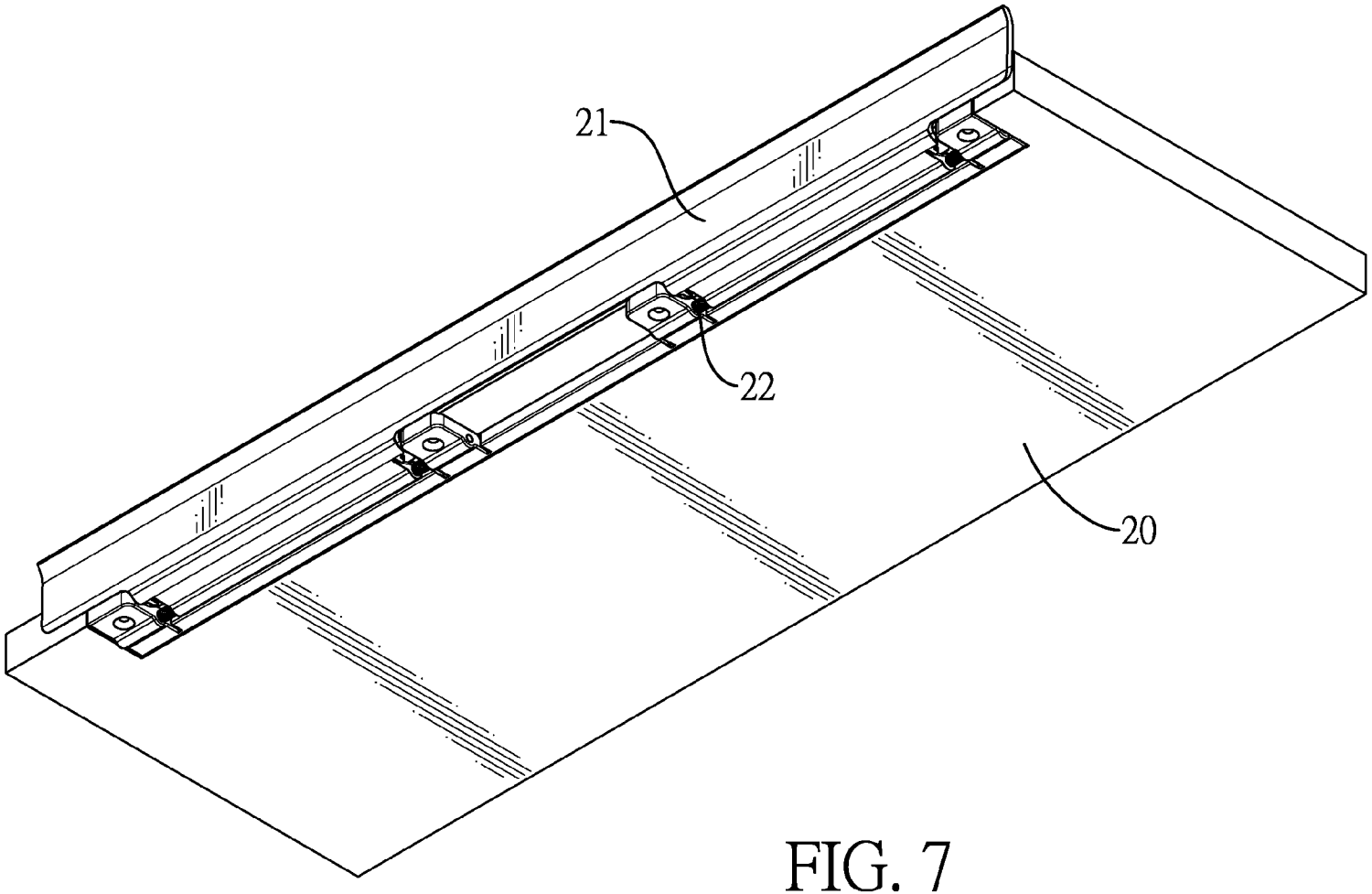
FIG. 7 is a bottom perspective view of the liftable table in FIG. 6.
Figure 8:
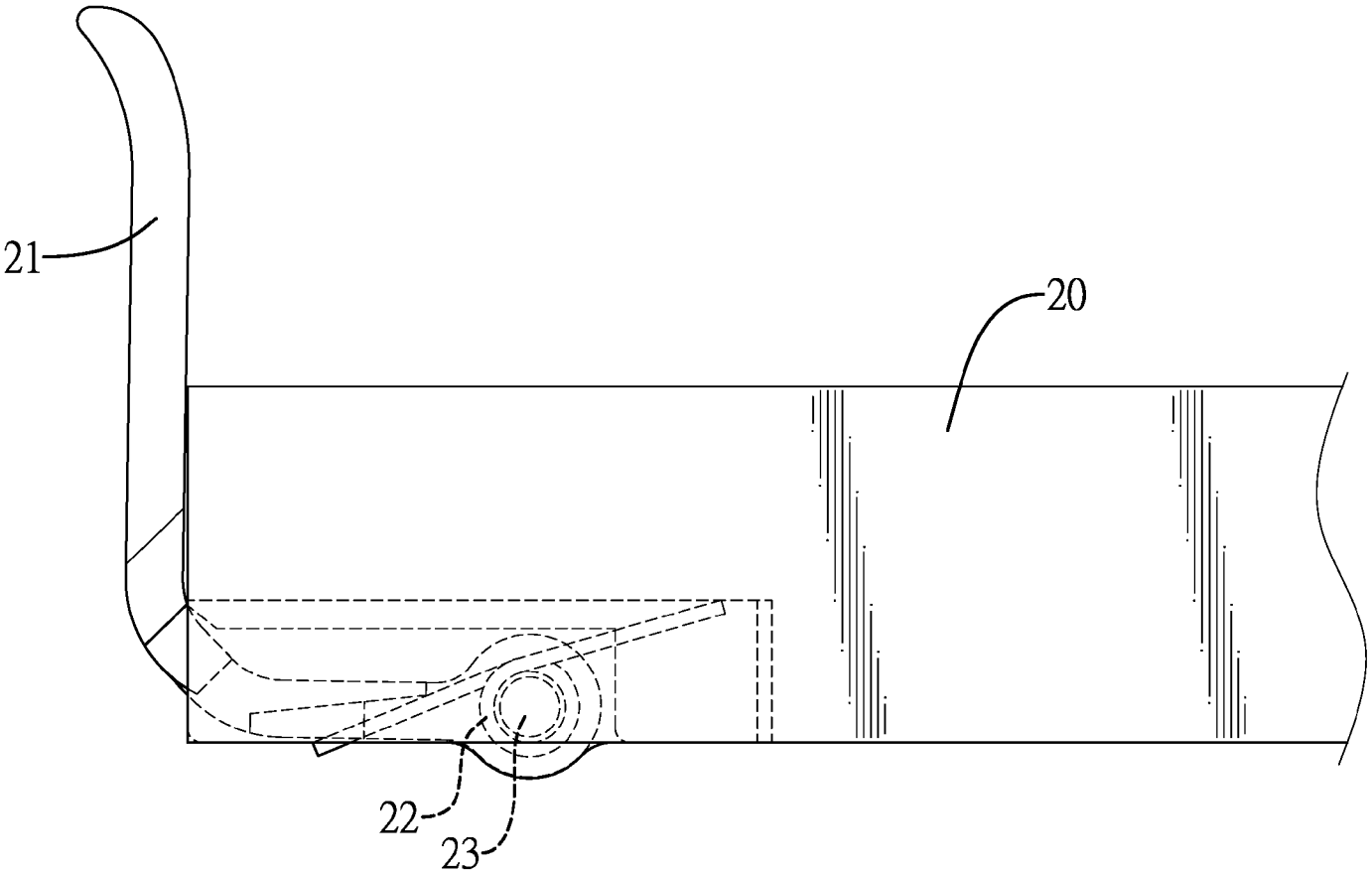
FIG. 8 is a side view of the liftable table in FIG. 6.
Figure 9:
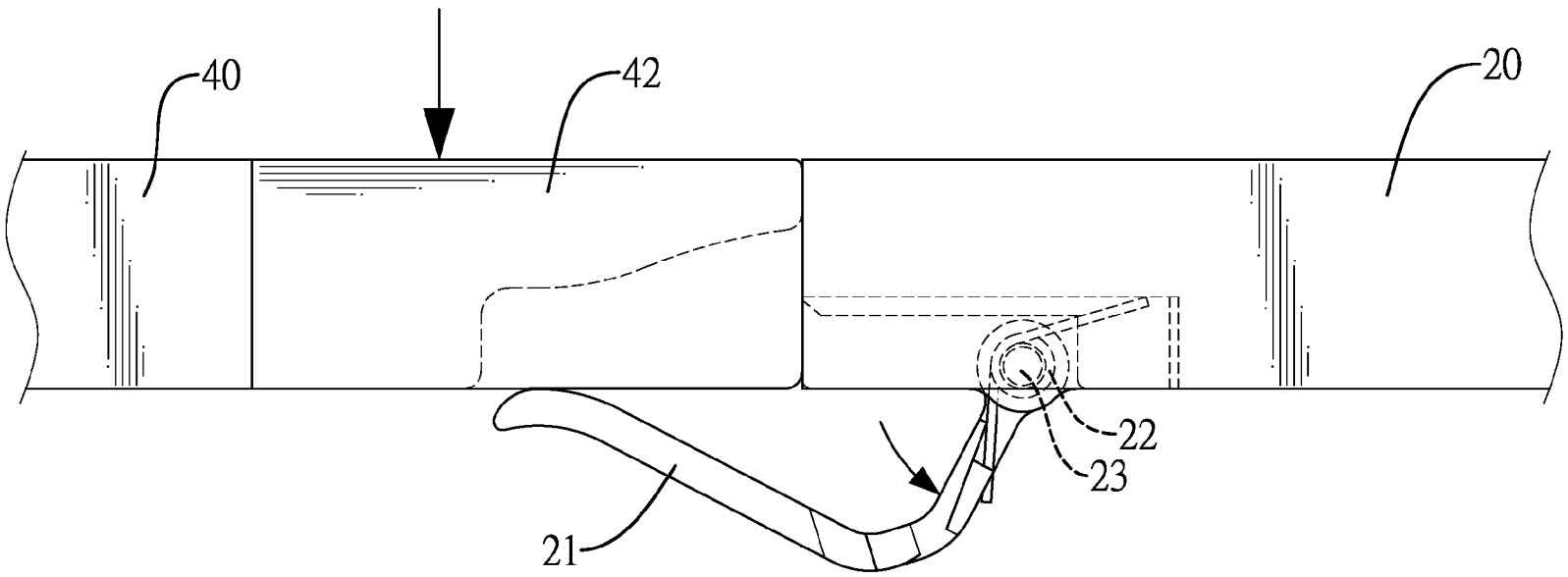
FIG. 9 is an enlarged and operational side view of the liftable table in FIG. 8.

With reference to FIG. 5, the table board 40 has two connecting mounts deposited on the bottom of the table board 40, and the connecting mounts are respectively connected to the upper ends of the second pivot arms 34 by hinges. In addition, the two second sliding recesses 41 are respectively formed in the connecting mounts of the table board 40, and each first pivot arm 33 has a sliding rod 331. Then, the sliding rods 331 of the first pivot arms 33 are respectively mounted in the second sliding recesses 41. Furthermore, a connecting shaft 341 is connected to the lower end of the second pivot arm 34 of each one of the crossing sets 32, and this may improve the stability of the table board 40. Additionally, two sliding blocks 342 are respectively deposited on two ends of the connecting shaft 341 and are respectively mounted in the first sliding recesses 13.

Further, with reference to FIG. 5, the driving set 31 has a motor 35, a screw driving unit, and a guiding unit 36. The motor 35 is deposited in the holding seat 12. The screw driving unit is connected to and driven by the motor 35. The guiding unit 36 is deposited in the holding seat 12 and has a guiding rack 37 and a sliding mount 38. The guiding rack 37 is deposited on a side of the motor 35. The sliding mount 38 is movably mounted on the guiding rack 37, and is connected to and driven by the screw driving unit. The lower ends of the second pivot arms 34 are connected to the sliding mount 38.

Additionally, a spindle of the motor 35 is connected to a bevel gear transmission 39 to change the transmitting direction by an angle of 90 degrees. The bevel gear transmission 39 has a driven gear wheel connected to a screw rod of the screw driving unit, and the screw driving unit has a threaded sleeve mounted around the screw rod and connected to the sliding mount 38. Then, the sliding mount 38 may be moved linearly by the motor 35 via the screw driving unit. The lower ends of the second pivot arms 34 are moved linearly by the sliding mount 38 along the guiding unit 36. Furthermore, the driving set 31 may be a linear power device such as cylinders or linear motors.

With reference to FIGS. 1 and 2, the liftable table has an upper screen 50 and a lower screen 51, the upper screen 50 is deposited upwardly on a rear side of the table board 40, and the lower screen 51 is deposited downwardly on the rear side of the table board 40 and below the upper screen 50. In addition, the liftable table has a control switch deposited on the bottom of the table board 40 adjacent to a front side of the table board 40 and electrically connected to the driving set 31. Furthermore, the control switch has a main switch 60, an up switch 61, and a down switch 62.

Figure 4:
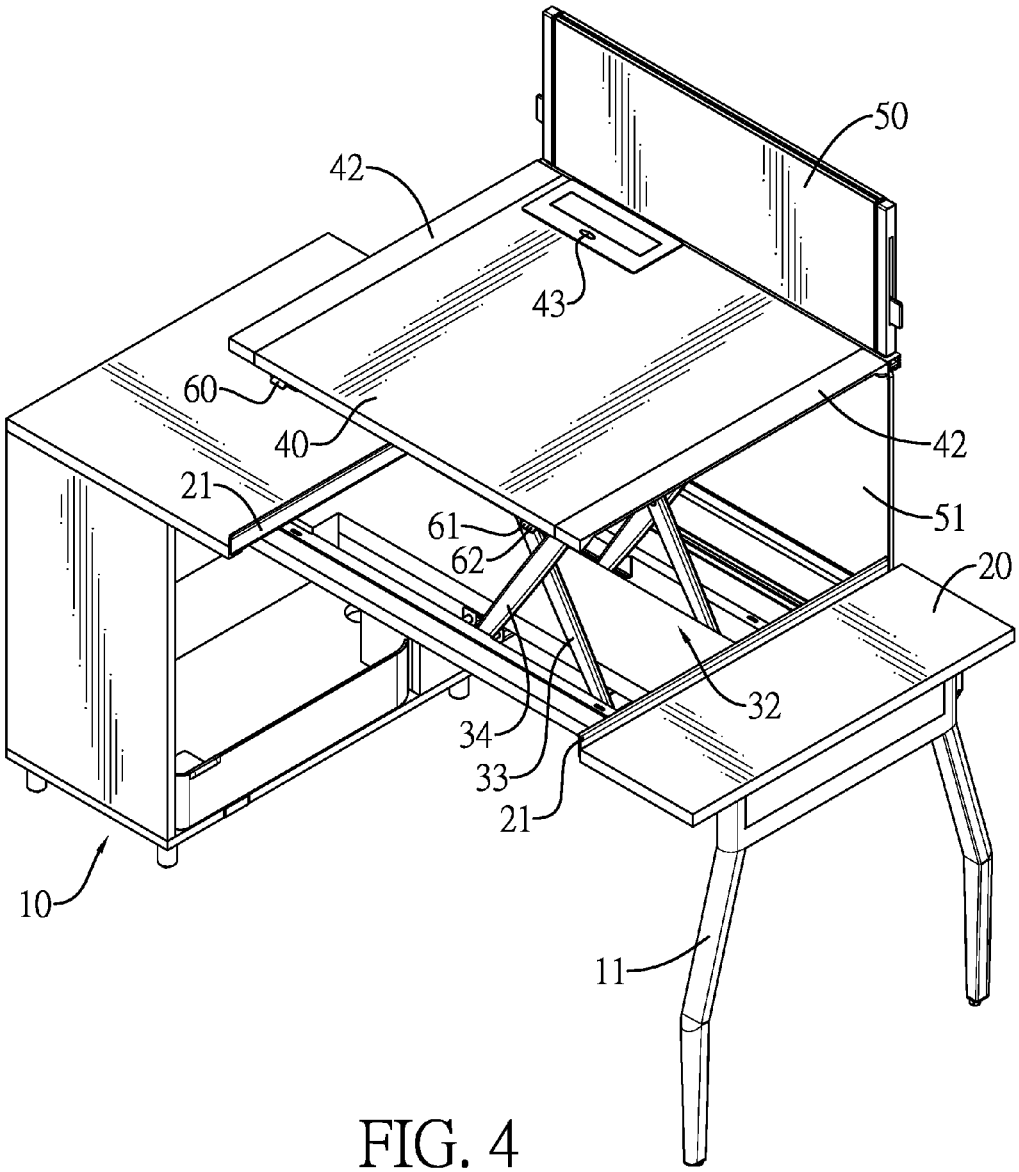
FIG. 4 is an operational perspective view of the liftable table in FIG. 1, showing the table board lifted upwardly.

In use, with reference to FIG. 1, a user may put a computer on the table board 40 and view and operate the computer with a sitting posture. When the user wants to view and operate the computer with a standing posture, the user may turn on the main switch 60 and then operate the up switch 61. With reference to FIGS. 4 and 5, the motor 35 of the driving set 31 may drive the screw driving unit, and the sliding mount 38 may be moved on the guiding rack 37 away from the motor 35 by the screw driving unit. Then, the lower end of the second pivot arms 34 that are connected to the sliding mount 38 are moved toward the lower ends of the first pivot arms 33. At the same time, the upper ends of the first pivot arms 33 are moved toward the upper ends of the second pivot arms 34 along the second sliding recesses 41. The crossing sets 32 may extend smoothly to lift the table board 40 upwardly. Consequently, when the table board 40 is moved upwardly relative to the table frame 10 as shown in FIG. 4, the user may view and operate the computer with a standing posture. Furthermore, when the user wants to view and operate the computer with a sitting posture again, the user only needs to press the down switch 62 to make the crossing sets 32 folded into the holding seat 12 and to move the table board 40 downwardly to the original position.

During the process of moving the table board 40 upward, the lower screen 51 is moved upwardly with the table board 40 to provide a shielding effect between the table board 40 and the fixing board 20, and this may improve the appearance of the liftable table. In addition, the upper screen 50 can be used to separate the table board 40 and a rear space adjacent to the rear side of the table board 40, and the user may have an independent work space.

Furthermore, when the table board 40 is moved downwardly in the embedding space of the fixing board 20, the buffering blocks 42 that are respectively deposited on the opposite sides of the table board 40 may avoid pinching the user's hands by accident. Additionally, when the table board 40 is moved upwardly, the blocking sheets 21 may provide a blocking effect to prevent objects such as pens that are put on the fixing board 20 from rolling down the holding seat 20. Further, the blocking sheets 21 may rise and depress automatically by the elastic force of the torsion springs 22 and the dropping force of the table board 40 without users' operation.

Moreover, the control switch of the liftable table having the main switch 60, the up switch 61 or the down switch 62 can be controlled to move the table board 40 after the main switch 60 is turned on, and this may prevent the unexpected upward or downward movement of the table board 40. Furthermore, the table board 40 has at least one power outlet 43 to provide power.

According to the above-mentioned features and structural relationships, the liftable table in accordance with the present invention may move the table board 40 upwardly or downwardly by the crossing sets 32 of the lifting device 30. When the crossing sets 32 of the lifting device 30 are extended, the table board 40 is moved upwardly, and when the crossing sets 32 of the lifting device 30 are folded, the table board 40 is moved downwardly. Then, the user may operate the computer with a sitting posture or a standing posture, and this may prevent the user from using the computer with the sitting posture for a long time and avoid causing some damages to the user's health. Additionally, the table board 40 can be moved upwardly or downwardly according to different heights of the users.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liftable table comprising:

a table frame having a main frame; and a holding seat deposited on the main frame, and having a top side;

an inner side;

an opening formed through the top side of the holding seat;

a receiving space formed in the holding seat and communicating with the opening of the holding seat; and at least one first sliding recess formed in the inner side of the holding seat;

a fixing board mounted on the main frame of the table frame and having two inner edges;

an embedding space deposited between the inner edges of the fixing board and communicating with the receiving space of the holding seat; and two blocking sheets respectively restorably pivoted on the inner edges of the fixing board adjacent to the embedding space of the fixing board, and each one of the blocking sheets having a rotating rod mounted through the blocking sheet and pivotally connected to the fixing board at the corresponding inner edge of the fixing board; and multiple torsion springs mounted around the rotating rod at spaced intervals and abutting against the blocking sheet;

a lifting device deposited on the holding seat of the table frame and having a driving set deposited on the holding seat; and at least one crossing set extended from or folded in the receiving space of the holding seat, connected to and driven by the driving set, and each one of the at least one crossing set having a first pivot arm having a lower end connected to the holding seat by hinges; and an upper end; and a second pivot arm pivotally connected to the first pivot arm, being moveable along the at least one first sliding recess of the holding seat, and having a lower end connected to the driving set; and an upper end; and a table board deposited on an upper end of the at least one crossing set of the lifting device to move upwardly or downwardly relative to the table frame, to be received in the embedding space of the fixing board, and having a bottom facing the opening of the holding seat; and at least one second sliding recess formed in the bottom of the table board; and wherein the upper end of the first pivot arm of the at least one crossing set is slidably mounted in the at least one second sliding recess, and the upper end of the second pivot arm of the at least one crossing set is connected to the table board by hinges.

2. The liftable table as claimed in claim 1, wherein the table board has two opposite sides respectively facing the inner edges of the fixing board; and two buffering blocks respectively deposited on the opposite sides of the table board and respectively corresponding to the blocking sheets of the fixing board.

3. The liftable table as claimed in claim 2, wherein the lifting device has two crossing sets, and the crossing sets are deposited in the holding seat symmetrically and side by side.

4. The liftable table as claimed in claim 3, wherein the table board has two connecting mounts deposited on the bottom of the table board and respectively connected to the upper ends of the second pivot arms of the crossing sets by hinges; and two second sliding recesses respectively formed in the connecting mounts of the table board; and the first pivot arm of each one of the crossing sets has a sliding rod mounted in one of the second sliding recesses of the table board.

5. The liftable table as claimed in claim 4, wherein the holding seat has two first sliding recesses formed in the inner side of the holding seat; and the second pivot arm of each one of the crossing sets has a connecting shaft connected to the lower end of the second pivot arm and having two ends; and two sliding blocks respectively deposited on the ends of the connecting shaft and respectively mounted in the first sliding recesses of the holding seat.

6. The liftable table as claimed in claim 2, wherein the liftable table has an upper screen deposited upwardly on a rear side of the table board; and a lower screen deposited downwardly on the rear side of the table board and below the upper screen.

7. The liftable table as claimed in claim 2, wherein the liftable table has a control switch deposited on the bottom of the table board adjacent to a front side of the table board and electrically connected to the driving set, and the control switch has a main switch, an up switch, and a down switch mounted on the bottom of the table board.

8. The liftable table as claimed in claim 1, wherein the lifting device has two crossing sets, and the crossing sets are deposited in the holding seat symmetrically and side by side.

9. The liftable table as claimed in claim 8, wherein the table board has two connecting mounts deposited on the bottom of the table board and respectively connected to the upper ends of the second pivot arms of the crossing sets by hinges; and two second sliding recesses respectively formed in the connecting mounts of the table board; and the first pivot arm of each one of the crossing sets has a sliding rod mounted in one of the second sliding recesses of the table board.

10. The liftable table as claimed in claim 9, wherein the holding seat has two first sliding recesses formed in the inner side of the holding seat; and the second pivot arm of each one of the crossing sets has a connecting shaft connected to the lower end of the second pivot arm and having two ends; and two sliding blocks respectively deposited on the ends of the connecting shaft and respectively mounted in the first sliding recesses of the holding seat.

11. The liftable table as claimed in claim 1, wherein the liftable table has an upper screen deposited upwardly on a rear side of the table board; and a lower screen deposited downwardly on the rear side of the table board and below the upper screen.

12. The liftable table as claimed in claim 1, wherein the liftable table has a control switch deposited on the bottom of the table board adjacent to a front side of the table board and electrically connected to the driving set, and the control switch has a main switch, an up switch, and a down switch mounted on the bottom of the table board.

* * * * *